US006292101B1

(12) United States Patent
Stoltz et al.

(10) Patent No.: US 6,292,101 B1
(45) Date of Patent: Sep. 18, 2001

(54) ANTI-THEFT ELEMENT IN AN ANTI-THEFT DEVICE

(75) Inventors: Klas Stoltz; Bo Gustavsson, both of Gökvägen (SE)

(73) Assignee: Färgklämman AB, Huddinge (SE)

( * ) Notice: Subject to any disclaimer, the term of this patent is extended or adjusted under 35 U.S.C. 154(b) by 0 days.

(21) Appl. No.: 09/514,248

(22) Filed: Feb. 28, 2000

Related U.S. Application Data

(60) Provisional application No. 60/124,883, filed on Mar. 17, 1999.

(30) Foreign Application Priority Data

Mar. 17, 1999 (SE) ..... 9900964

(51) Int. Cl.[7] ..... G08B 13/14

(52) U.S. Cl. ..... 340/572.8; 340/571; 340/572.9; 340/590; 116/211; 116/214; 109/29

(58) Field of Search ..... 340/572.8, 572.9, 340/572.1, 590, 571, 572.3; 116/214, 211; 109/29, 20

(56) References Cited

U.S. PATENT DOCUMENTS 4,483,049 * 11/1984 Gustavsson et al. ..... 24/160
4,649,397 * 3/1987 Heaton et al. ..... 343/895
4,670,950 * 6/1987 Wisecup et al. ..... 24/150 R
5,275,122 * 1/1994 Stoltz et al. ..... 116/200
5,392,620 * 2/1995 Stoltz et al. ..... 70/57.1
5,438,738 * 8/1995 Stolz et al. ..... 24/704.1
5,617,799 * 4/1997 Kaczorowski ..... 109/29
5,745,965 * 5/1998 Stoltz et al. ..... 24/704.1
5,953,799 * 9/1999 Seidel ..... 24/704.1
6,191,692 * 2/2001 Stoltz et al. ..... 340/572.9

FOREIGN PATENT DOCUMENTS

97/50066 12/1997 (WO) .

* cited by examiner

*Primary Examiner*—Jeffery Hofsass
*Assistant Examiner*—Phung T Hguyen
(74) *Attorney, Agent, or Firm*—Browdy and Neimark

(57) ABSTRACT

The present invention relates to an anti-theft element in an anti-theft device which is intended to be attached to a theft-attractive article such that said device can only be removed from the article with the aid of a special release device. The anti-theft element includes a fouling-substance ampule which contains a fouling substance and which is disposed in the anti-theft element so as to be broken, crushed or otherwise destroyed or opened so as to release said fouling substance if an attempt is made to release the anti-theft device from the theft-attractive article without the aid of said special release device. The ampule (2) encloses a first fouling substance (B; D; G) having a specific fouling property, and at least one second fouling substance (C; E, F; H) having a fouling property which differs from the fouling property of the first fouling substance (B; D; G). The chemical composition of the respective first fouling substance (B; D; G) and of said second fouling substance (C; E, F; H) is such that the fouling substances (B, D, G; C, E, F, H) will not dissolve in one another. The invention also relates to a fouling-substance ampule intended for inclusion in an anti-theft element.

20 Claims, 2 Drawing Sheets

ANTI-THEFT ELEMENT IN AN ANTI-THEFT DEVICE

Figure 1A:
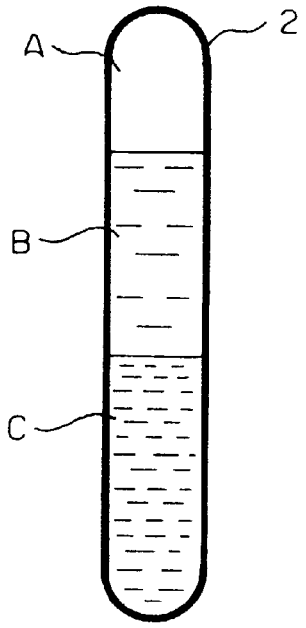

This claims the benefit of U.S. Provisional of copending parent application Ser. No. 60/124,883, filed Mar. 17, 1999.

The present invention relates to an anti-theft element for use in an anti-theft device which is intended to be attached to a theft-attractive article in a manner such that the device can only be released from said article with the aid of a special release device. The anti-theft element includes an ampule which contains a so-called fouling substance, for instance a stain, a corrosive substance, an ill-smelling substance or any other article-defacing and article-spoiling substance, and which is so arranged in the anti-theft element that any attempt to release the anti-theft device from the theft-attractive article without the aid of the release device will result in the anti-theft element being broken, crushed, destroyed or opened in some other way such that the fouling substance is released. The invention also relates to a fouling substance ampule intended for inclusion in an anti-theft element.

Anti-theft or theft-deterrent devices of this kind are attached to theft-attractive articles, such as clothes, suitcases and other easily carried goods on sale in stores and like establishments, and are used to prevent or deter theft of such articles. Such a device is intended to be attached to the article in such a manner that the device can only be released with the aid of a special release device, it being assumed that potential thieves lack access to such a device. Attempts to remove the anti-theft device from an article without the aid of said release device will render the article practically unusable, either by tearing the article or by fouling the article with the fouling substance contained in the ampule as the ampule breaks and releases said substance, so as to stain, corrode or otherwise damage the article. Thus, in its capacity as a theft deterrent an anti-theft device of this kind shall be able to stain different types of goods and materials, such as the cloth in an article of clothing, the leather of a shoe or suitcase, handbag, or some other material from which an article is comprised, so as to render the article practically unusable.

Anti-theft devices that include ampules which contain a fouling substance that has a given fouling effect are known to the art; see for instance U.S. Pat. No. 5,438,738. For instance, the fouling substance enclosed in the ampule is a stain which contains a pronounced pigment, which may be light in colour, for instance yellow, or dark in colour, for instance blue, and which will have a fouling effect, i.e a staining effect, on the article concerned when the colour of the stain deviates sufficiently from the colour or tone of the cloth, leather or material from which the article is made. If the colour of the stain does not differ markedly from the colour of the article to which the device is attached, the anti-theft device together with its visible ampule enclosing the stain will loose its deterring capacity.

Anti-theft devices that include several ampules containing fouling substances are also known to the art; see for instance U.S. Pat. No. 5,275,122. Such a known anti-theft device includes an anti-theft element which comprises double ampules that are placed on a respective side of a connecting element which is sensitive to irregular manipulation of the device and which is threaded through or pierced through the article concerned and interconnects both elements in the anti-theft device. An anti-theft element of this kind may, for instance, include an ampule that contains a light stain and which will therefore stain a dark cloth or material, and a second ampule which contains a dark stain which will therefore stain a light cloth or material. One drawback with an anti-theft device of this kind is that it is expensive to produce because it includes double ampules and because the cost of the ampules constitutes a major part of the production costs of the anti-theft device as a whole. Another drawback is that an unauthorised person may be able to manipulate the anti-theft device so that only one of the two ampules will break. As mentioned above with respect to the single ampule solution, this may mean that the stain contained in the broken ampule will not deviate sufficiently in colour from the material from which the article is made and therewith render the article unusable.

The object of the present invention is to solve the aforesaid problems, by providing an anti-theft device that includes an ampule containing a fouling substance with which the cost of producing the device and the weight of said device can be kept to a low, competitive level and which is effective in fouling or marking the theft-attractive article in a more pronounced manner than was earlier the case, so as to cause the article to become unusable if the anti-theft device is manipulated in an irregular manner.

This object is achieved in accordance with the invention by means of an anti-theft element in an anti-theft device, and a fouling substance ampule having the characteristic features set forth in the following claims.

One advantage afforded by the inventive anti-theft device is that it can be used highly effectively as a theft deterrent with all types of theft-attractive goods, regardless of the type of goods concerned, their colour and the material from which they are made. The device has the added advantage of being simple and reliable in construction, which results in low production costs and low weight. These advantages are achieved by means of an anti-theft device adapted for a single ampule that contains at least two different fouling substances which will not readily dissolve in one another or which are unable to dissolve in each other. The fouling substances have mutually different fouling properties, meaning that if one of these fouling substances does not distinguish sufficiently from the theft-attractive article, it is ensured that the remaining substance or substances released simultaneously with the first-mentioned substance and having a different fouling property, for instance a different colour, will render the article unusable. Thus, it is not possible to manipulate the inventive anti-theft device in an irregular manner without releasing a plurality of fouling substances, e.g. stains, that have mutually different properties.

Because the cost of an ampule in an anti-theft device of this kind constitutes a major part of the total manufacturing cost of the device, about 40% in the case of a single ampule solution and about 60–75% in the case of a two-ampule solution, the inventive anti-protective device has a competitive advantage over known multi-ampule solutions due to its low production cost. The simple construction of the inventive anti-theft device also results in a device which is light in weight, therewith reducing the chance of the article being damaged when the anti-theft device is handled normally in the store.

In accordance with the invention, the ampule containing the fouling substances is clearly visible from one side of the anti-theft device and will therefore have an enhanced theft deterring effect by virtue of the fact that the fouling substances in the ampule are mutually immiscible and therewith show clearly that any attempt to release the anti-theft device from the article in an irregular manner would result in the article being stained, impaired or likewise fouled, so as to become useless, regardless of the specific properties of individual theft-attractive articles.

According to one advantageous embodiment of the invention, the fouling substance phases enclosed in the ampule have mutually different densities, so that said substances will be layered and clearly delimited in the ampule, with a clear boundary between adjacent phases.

The terms "ampule" and "fouling substance ampule" used in the present context thus refer to ampules which are independently produced units that can be fitted into an anti-theft element. The terms, however, also refer within the scope of the invention to ampules that are formed by and constitute a part of the construction of the anti-theft element and which define a cavity that contains fouling substances. In the event of attempting to remove the anti-theft device in an irregular manner, e.g. by force, the cavity will be broken open, e.g., along fracture weakenings in the cavity wall, so as to release the enclosed fouling substances.

Figure 2:
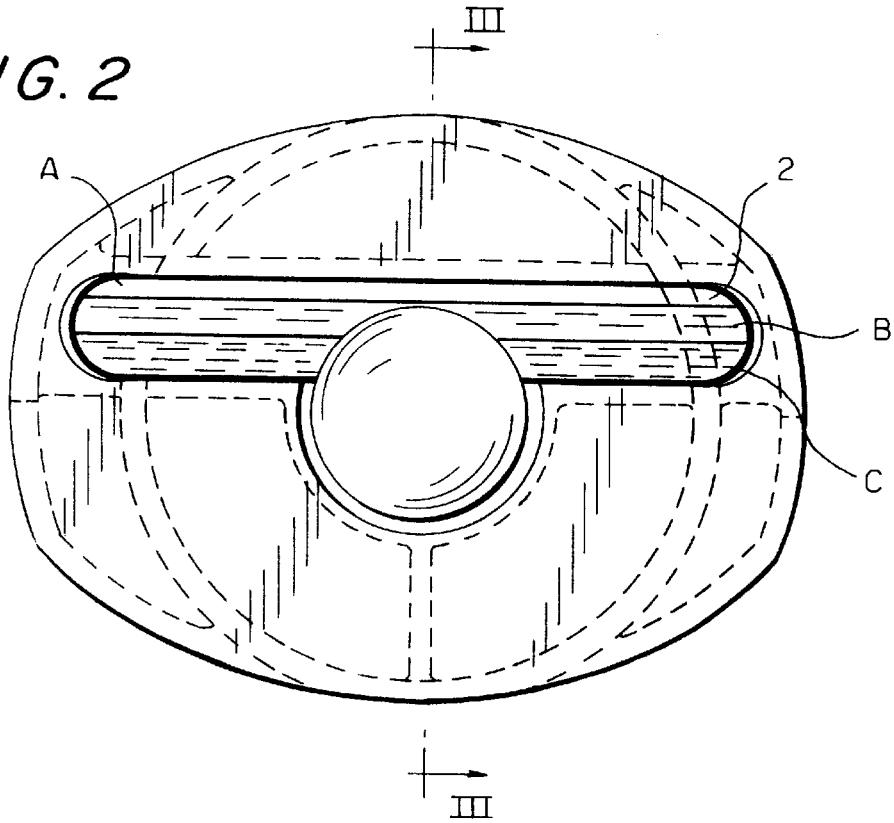
Figure 3:
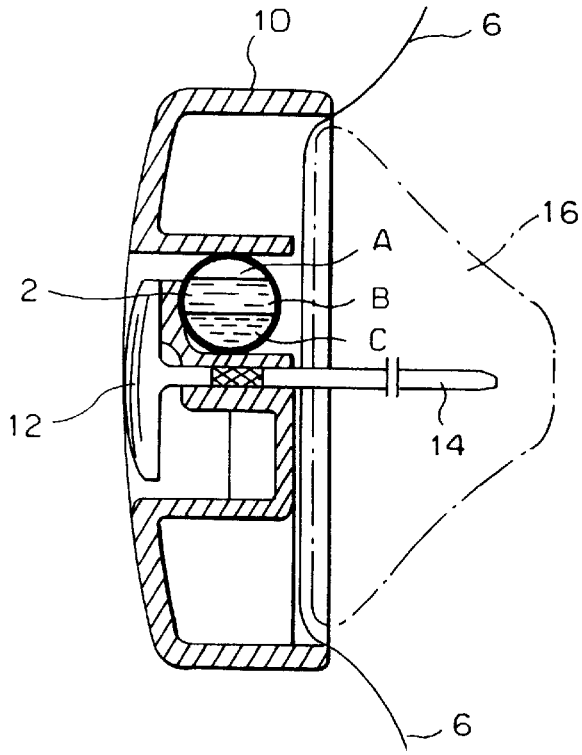

The invention will now be described in more detail with reference to exemplifying embodiments thereof and also with reference to the accompanying drawings, in which FIGS. 1*a,* 1*b* and 1*c* illustrate respectively different examples of embodiments of an inventive fouling substance ampule, with the ampule of FIGS. 1*a* and 1*b* being shown upstanding and the ampule in FIG. 1*c* being shown in a recumbent position;

FIG. 2 illustrates an exemplifying embodiment of an inventive anti-theft device from above; and FIG. 3 is a cross-sectional view of the anti-theft device shown in FIG. 2, taken on the lines III—III in FIG. 2.

Those component parts that find mutual correspondence in the Figures have been identified by the same reference signs.

Figure 1B:
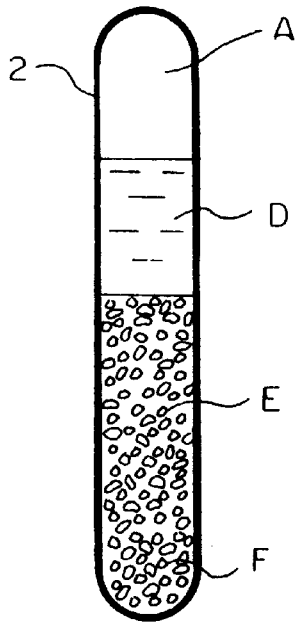
Figure 1C:
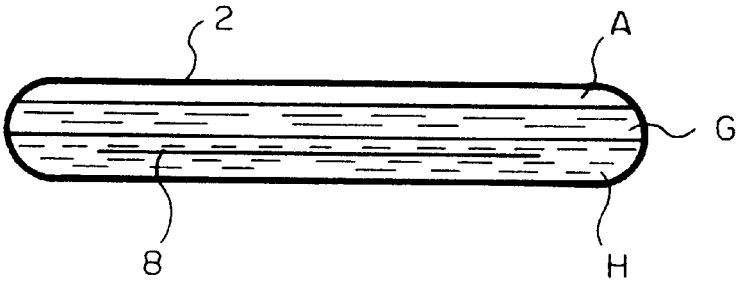

FIGS. 1*a*–1*c* illustrate tubular, circular-cylindrical ampules 2 which are made of glass or some other fragile material, such as a plastic material for instance, and which contain fouling substances. In the illustrated case, the substance in the ampules 2 are stains that are intended to discolour an article that comes into contact therewith, or to spoil the article in some other way. The internal pressure of the ampule may be above atmospheric pressure, or equal to atmospheric pressure, or a pressure below atmospheric pressure.

FIG. 1*a* illustrates a first fouling substance ampule according to the invention in an upstanding position. The illustrated ampule 2 contains a given volume of air A, preferably about 20–30 volume-%, and two mutually different fouling substances, i.e. a first staining substance B and a second staining substance C. In the case of this embodiment, the two substances B and C consist in two liquid phases of mutually different colours which will therefore produce stains that distinguish from one another. For instance, the substance B may consist of an oil-based solution having a light, oil-dissolvable pigment or colorant, such as yellow for instance, while the substance C may consist in a water-based liquid phase that has a dark-coloured, water-soluble pigment or colorant, such as a dark blue colorant, for instance. According to this embodiment, the distinct liquid phases B and C have mutually different densities and therefore separate into different layers with a clear phase boundary therebetween. The heavier phase (the bottom phase) is comprised of the water-based staining substance C, while the lighter phase (the top phase) is comprised of the oil-based staining substance B.

FIG. 1*b* illustrates a second embodiment of an inventive ampule that contains fouling substances. In addition to containing air A, the illustrated ampule 2 also contains three mutually different stains D, E and F that form three different coloured liquid phases which do not dissolve readily in one another or which are insoluble in one another. The stain D has the lowest density and therewith forms the upper phase in the ampule. The stains E and F of the illustrated embodiment have essentially the same density, meaning that the liquid phases E and F form bottom phases with a phase boundary against the stain D. The stains E and F are mutually immiscible but form bubbles in a known manner, as illustrated schematically in FIG. 1*b*. The different stains D, E and F have different fouling properties and may contain mutually different pigments or colorants. The stain D may consist in a water-based phase containing a water soluble colorant, whereas the stains E and F may respectively consist in a fatty-acid based phase containing a colorant which is soluble in fatty acid and a silicone-oil based phase containing a colorant that is dissolvable in silicone oil. The densities of the phases based on fatty acid and silicone oil respectively are generally the same, and lower than the density of the water-based phase.

The liquid phases E and F may, of course, also form liquid phases of mutually different densities, so as to form different layers with intermediate phase boundaries. A water-insoluble top phase based on oleic acid, an intermediate phase based on silicone oil and a water-based bottom phase are examples of three different liquid phases that will not readily dissolve in one another or that will not dissolve in one another at all, and that have mutually different densities.

FIG. 1*c* illustrates another embodiment of an inventive ampule, shown in a horizontal position. In addition to air A, the ampule 2 also contains two different stains G, H in different liquid phases, and an alarm element 8. The alarm element 8 is sensed by an electronic alarm system, normally installed on the store premises and is enclosed in the ampule together with the stains so as to be inaccessible to external influences provided that the ampule is not broken, crushed or destroyed in some other way so as to release the stains. A stain containing ampule which also encloses an alarm element is described in more detail in WO 97/50066, to which reference is made herewith.

In the case of the illustrated exemplifying embodiments of the invention, at least one of the fouling substances may have a property that is different to the others, for instance may have a strong smelling or a corrosive property. One of the fouling substances may alternatively comprise a liquid phase that consists of a chemical mixture which contains a trace element for identification purposes, for instance a trace substance that can be identified with a certain producer. The trace substance may comprise a chemical that is not normally found in a colorant or other fouling substance, for instance a magnetic liquid.

FIGS. 2 and 3 illustrate an exemplifying embodiment of an antitheft device provided with an ampule 2 that contains a fouling substance in accordance with the ampule embodiment shown in FIG. 1*a,* for instance.

The anti-theft device includes a first anti-theft element 10 which has a base element 12 and an elongated connecting element 14 which projects out from the base element and which is intended to be inserted through the article 6 to be protected. A second element 16 (shown only schematically in FIG. 3) is adapted for attachment to the connecting element 14 and to be locked thereon against movement away from the base element 12, so as to hold the anti-theft device securely on the article 6. One of the elements, in the illustrated case the anti-theft element 10, includes a theft deterrent.

According to the invention, the anti-theft element comprises a fragile ampule which contains fouling substances and which may be of the kind shown in FIGS. 1*a*–1*c*. The ampule 2 is transparent and is placed for instance so as to be well visible from outside the anti-theft device. Thus, when the anti-theft device is secured to a theft-attractive article, a potential thief is able to see and identify the contents of the ampule. It is therewith possible to see clearly from outside the anti-theft device that the fouling substances enclosed in the ampule will render the article unusable if the ampule should break, which will have a clear theft deterring effect.

If an attempt is made to loosen the second element 16 forcibly from the connecting element 14, the tension forces and/or lateral forces exerted on the element 16, and as a result also on the connecting element 14 and the base element 12, will cause the ampule 2 to break. As the ampule breaks, its contents will be dispersed onto the article 6 and therewith destroy and render said article unusable.

The ampule 2 illustrated in FIG. 1*c* will break in the same way and its contents destroy the article 6 if an attempt is made to render the alarm element 8 inactive in an irregular manner.

It will be understood that the invention is not restricted to the aforedescribed and illustrated exemplifying embodiments thereof, and that several conceivable modifications can be made within the scope of the following claims. For instance, in addition to enclosing the substances that have mutually different fouling properties, the ampule may also enclose an inner fragile ampule, preferably a thin-walled ampule. The inner ampule is intended to be broken or crushed at the same time as the ampule containing said fouling substances, and will contain a substance which will react with the fouling substances in a suitable manner when coming into contact with said substance or substances. For instance, the inner ampule may hold a catalyst which causes the fouling substance or substances concerned to react with each other, or a hardener which causes the fouling substance or substances to harden and become permanently fixed to the theft attractive article. The inner ampule may also contain a further fouling substance, such as a colorant, with properties different to the fouling substance or substances in the outer ampule.

What is claimed is:

1. An anti-theft element for an anti-theft device which is intended to be attached to a theft-attractive article such that said device can only be removed from the article with the aid of a special release device, said antitheft element including an ampule which contains a fouling substance and is disposed in said anti-theft element so as to be broken, crushed or destroyed or opened in some other way such as to release the fouling substance enclosed in the ampule should an attempt be made to release the anti-theft device from the theft-attractive article without the aid of said special release device, characterised in that the ampule (2) encloses a first fouling substance (B; D; G) having a specific fouling property, and at least one second fouling substance (C; E, F; H) having a fouling property that differs from the fouling property of said first fouling substance (B; D; G), and in that the chemical composition of the respective first fouling substance (B; D; G) and second fouling substance (C; E, F; H) is such that said substances (B, D, G; C, E, F; H) will not dissolve in one another.

2. An anti-theft element according to claim 1, characterised in that the fouling substances (B, D, G; C, E, F, H) are stains of mutually different colours.

3. An anti-theft element according to claim 2, characterised in that one of the stains (B, D, G; C, E, F, H) has a dark tint and another stain (C, E, F, H; B, D, G) has a light tint.

4. An anti-theft element according to claim 1, characterised in that the density of the first fouling substance (B; D; G) differs from the density of the second fouling substance (C; E, F; H).

5. An anti-theft element according to claim 4, characterised in that said one fouling substance (B; D; G) is oil based and the other fouling substance (C; E, F; H) is water based.

6. An anti-theft element according claim 1, characterised in that the ampule (2) encloses a third fouling substance (F) whose fouling property differs from the fouling properties of the first fouling substance (B; D; G) and the second fouling substance (C; E; H), and in that the chemical composition of the third fouling substance (F) is such that said third substance will not dissolve in the first substance (B; D; G) nor in the second substance (C; E; H).

7. An anti-theft element according to claim 1, characterised in that the ampule (2) encloses an alarm element (8) which can be sensed by an electronic alarm system and which is inaccessible to external influences unless the ampule (2) is broken, crushed or destroyed in some other way such as to release the fouling substances (B–H).

8. An anti-theft element according to claim 1, characterised in that the ampule (2) is made of glass or a plastic material.

9. An anti-theft element according to claim 1, characterised in that the ampule (2) also encloses an inner, fragile ampule which contains a substance that influences or supplements at least one of the surrounding fouling substances.

10. A fouling-substance containing ampule which is intended to be fitted in an anti-theft element in an anti-theft device intended to be attached to a theft-attractive article such that said device can only be removed from said article with the aid of a special release device, said ampule enclosing a fouling substance and being disposed in the anti-theft element so as to be broken, crushed or otherwise destroyed or opened such as to release the fouling substance enclosed in said ampule should an attempt be made to release the anti-theft device from the theft-attractive article without the aid of said special release device, characterised in that the ampule (2) encloses a first fouling substance (B; D; G) having a specific fouling property, and at least one second fouling substance (C; E, F; H) having a fouling property which differs from the fouling property of the first fouling substance (B; D; G), and in that the chemical composition of said respective first fouling substance (B; D; G) and said second fouling substance (C; E, F; H) is such that said substances (B, D, G; C, E, F, H) will not dissolve in one another.

11. A fouling-substance ampule according to claim 10, characterised in that the fouling substances (B, D, G; C, E, F, H) are stains of mutually different colours.

12. A fouling-substance ampule according to claim 11, characterised in that one of said stains (B, D, G; C, E, F, H) has a dark tint and another stain (C, E, F, H; B, D, G) has a light tint.

13. A fouling-substance ampule according to claim 10, characterised in that the density of the first fouling substance (B; D; G) differs from the density of the second fouling substance (C; E, F; H).

14. A fouling-substance ampule according to claim 13, characterised in that one fouling substance (B; D; G) is oil based and the other fouling substance (C; E, F; H) is water based.

15. A fouling-substance ampule according to claim 10, characterised in that the ampule (2) encloses a third fouling substance (F) having a fouling property that differs from the fouling properties of said first fouling substance (B; D; G) and said second fouling substance (C; E; H), and in that the chemical composition of the third fouling substance (F) is such that it will not dissolve in the first fouling substance (B; D; G) or in the second fouling substance (G; E; H).

16. A fouling-substance ampule according to claim 10, characterised in that the ampule (2) is made of glass or a plastic material.

17. A fouling-substance ampule according to claim 10, characterised in that the ampule (2) also encloses an inner, fragile ampule which encloses a substance that influences or supplements at least one of the surrounding fouling substances.

18. A fouling-substance ampule according to claim 12 characterized in that the density of the first fouling substance (B;D;G) differs from the density of the second fouling substance (C;E,F;H).

19. A fouling substance ampule according to claim 18, characterized in that the ampule (2) also encloses an inner, fragile ampule which encloses a substance that influences or supplements at least on of the surrounding fouling substances.

20. An anti-theft element according to claim 5 characterized in that the ampule (2) encloses an alarm element (8) which can be sensed by an electronic alarm system and which is inaccessible to external influences unless the ampule (2) is broken, crushed or destroyed in some other way such as to release the fouling substances (B–H).

* * * * *